US010096232B1

(12) United States Patent
Basu et al.

(10) Patent No.: US 10,096,232 B1
(45) Date of Patent: Oct. 9, 2018

(54) PORTABLE SECURITY ALARM DEVICE

(71) Applicant: USA Innovations, Inc., Sanford, NC (US)

(72) Inventors: Shubhankar Basu, San Francisco, CA (US); Samuel Alec Mansen, San Francisco, CA (US)

(73) Assignee: USA Innovations, Inc., Sanford, NC (US)

( * ) Notice: Subject to any disclaimer, the term of this patent is extended or adjusted under 35 U.S.C. 154(b) by 0 days.

(21) Appl. No.: 15/795,149

(22) Filed: Oct. 26, 2017

(51) Int. Cl.
*G08B 13/14* (2006.01)
*G08B 25/00* (2006.01)
*G08B 3/10* (2006.01)

(52) U.S. Cl.
CPC ..... *G08B 25/001* (2013.01); *G08B 3/10* (2013.01); *G08B 13/1427* (2013.01); *G08B 25/009* (2013.01)

(58) Field of Classification Search
None
See application file for complete search history.

(56) References Cited

U.S. PATENT DOCUMENTS 3,938,126 A 2/1976 Ransom
4,121,160 A 10/1978 Cataldo
4,189,721 A 2/1980 Doell
4,591,836 A 5/1986 Feigenblatt, Jr. et al.
4,665,389 A 5/1987 Clendening
4,858,957 A 8/1989 Capozzola
4,888,580 A 12/1989 Distel
5,075,671 A 12/1991 Livingston, III
5,157,640 A 10/1992 Backner
5,218,344 A 6/1993 Ricketts
5,285,430 A 2/1994 Decker
5,420,570 A 5/1995 Leitten et al.
5,570,081 A 10/1996 Holstrom et al.
5,574,433 A 11/1996 Bahcall
5,652,570 A 7/1997 Lepkofker
5,712,619 A 1/1998 Simkin
5,748,089 A 5/1998 Sizemore
(Continued)

FOREIGN PATENT DOCUMENTS

CN 104063988 9/2014
CN 203849830 9/2014
(Continued)

*Primary Examiner* — Thomas McCormack
(74) *Attorney, Agent, or Firm* — Fish & Richardson P.C.

(57) ABSTRACT

A portable security alarm device includes a subscriber identification module (SIM) card operable to store an international mobile subscriber identity (IMSI) number and a related key that together identify the PSAD to a mobile telephone carrier, a cellular antenna, a GPS antenna and a GPS receiver communicatively coupled to the GPS antenna, a battery coupled to a sense circuit and operable to power the PSAD, a quick release switch operable to provide a signal indicating an occurrence of a one-stroke activation of the quick release switch by a user, an alarm operable to provide a loud warning sound, and a microcontroller including one or more processors and memory, where the microcontroller is operatively coupled to hardware components of the device, and where the microcontroller is configured with an operating system and software components, the software components including software configured to control the hardware components of the PSAD and perform operations.

20 Claims, 9 Drawing Sheets

(56) References Cited

U.S. PATENT DOCUMENTS

| | | | |
|---|---|---|---|
| 5,793,710 | A | 8/1998 | Jacobi, Jr. et al. |
| 5,838,237 | A | 11/1998 | Revell et al. |
| 5,861,797 | A | 1/1999 | Becker |
| 5,923,255 | A | 7/1999 | Vandatshoar |
| 5,936,530 | A | 8/1999 | Meinhold |
| 5,940,004 | A | 8/1999 | Fulton |
| 5,955,952 | A | 9/1999 | Bergman et al. |
| 6,044,257 | A | 3/2000 | Boling et al. |
| 6,064,307 | A | 5/2000 | Silver |
| 6,285,289 | B1 | 9/2001 | Thornblad |
| 6,310,539 | B1 | 10/2001 | Rye et al. |
| 6,477,117 | B1 | 11/2002 | Narayanaswami et al. |
| 6,546,088 | B2 | 4/2003 | Campbell |
| 6,624,754 | B1 | 9/2003 | Hoffman et al. |
| D489,346 | S | 5/2004 | Lowinger |
| 7,864,059 | B2 | 1/2011 | Lee |
| 8,004,399 | B2 | 8/2011 | Reyes et al. |
| 8,013,734 | B2 | 9/2011 | Saigh et al. |
| 8,088,043 | B2 | 1/2012 | Andren et al. |
| 8,099,526 | B2 | 1/2012 | Griffin et al. |
| 8,408,436 | B2 | 4/2013 | Berry et al. |
| 8,370,549 | B2 | 5/2013 | Burton et al. |
| 8,461,983 | B2 | 6/2013 | McCauley |
| 8,469,862 | B2 | 6/2013 | Andren |
| 8,659,414 | B1 | 2/2014 | Schuk |
| 8,917,187 | B2 | 12/2014 | Matte |
| 9,020,462 | B2 | 4/2015 | Hodgson et al. |
| D734,328 | S | 7/2015 | Song |
| 9,282,179 | B2 | 3/2016 | Ushakov |
| 9,285,779 | B2 | 3/2016 | Almudafier |
| D756,241 | S | 5/2016 | Gabor |
| 9,338,627 | B1 | 5/2016 | Singh et al. |
| 9,426,558 | B2 | 8/2016 | Burt et al. |
| D765,897 | S | 9/2016 | Dir |
| 9,478,108 | B2 | 10/2016 | Matte et al. |
| 9,542,816 | B1 | 1/2017 | Amit Verma et al. |
| D782,717 | S | 3/2017 | Dir |
| D791,380 | S | 7/2017 | Dir |
| 9,704,368 | B2 | 7/2017 | Dehart |
| 2006/0267760 | A1 | 11/2006 | Shecter |
| 2007/0279219 | A1 | 12/2007 | Warriner |
| 2008/0211677 | A1 | 9/2008 | Shecter |
| 2008/0227429 | A1 | 9/2008 | Hodgson et al. |
| 2009/0096602 | A1 | 4/2009 | Reyes et al. |
| 2009/0138636 | A1 | 5/2009 | Burton et al. |
| 2009/0139764 | A1 | 6/2009 | Berry et al. |
| 2009/0163322 | A1 | 6/2009 | Andren et al. |
| 2009/0174548 | A1 | 7/2009 | Chan et al. |
| 2009/0187676 | A1 | 7/2009 | Griffin et al. |
| 2009/0289785 | A1 | 11/2009 | Leonard |
| 2009/0289807 | A1 | 11/2009 | Enwright et al. |
| 2010/0026500 | A1 | 2/2010 | Lee |
| 2010/0066558 | A1 | 3/2010 | McCauley |
| 2010/0117852 | A1 | 5/2010 | Matte |
| 2010/0127856 | A1 | 5/2010 | Sipple |
| 2013/0197369 | A1 | 8/2013 | Xiang |
| 2014/0079271 | A1 | 3/2014 | Burt et al. |
| 2014/0285355 | A1 | 9/2014 | Matte et al. |
| 2015/0289607 | A1 | 10/2015 | Lee et al. |
| 2015/0317356 | A1 | 11/2015 | Deichler |
| 2015/0358450 | A1 | 12/2015 | Ushakov |
| 2016/0260315 | A1 | 9/2016 | Singh et al. |

FOREIGN PATENT DOCUMENTS

| | | |
|---|---|---|
| DE | 202016000756 | 5/2017 |
| EP | 2237238 | 10/2010 |
| EP | 2378496 | 10/2011 |
| EP | 2378496 | 7/2013 |
| WO | WO 2010044794 | 4/2010 |
| WO | WO 2010088712 | 8/2010 |
| WO | WO 2012150382 | 11/2012 |

PORTABLE SECURITY ALARM DEVICE

TECHNICAL FIELD

This specification relates to security alarm devices.

BACKGROUND

Security systems are used for providing security to homes, businesses, and vehicles. Some security systems include an audible feature, e.g., an alarm, that is sounded upon being triggered in an alarm. Some security systems may also include one or more communication systems for communicating with other systems, e.g., with emergency response systems and monitoring systems.

SUMMARY

In general, one innovative aspect of the subject matter described in this specification can be embodied in a portable security alarm device ("PSAD"). The device includes a subscriber identification module (SIM) card operable to store an international mobile subscriber identity (IMSI) number and a related key that together identify the PSAD to a mobile telephone carrier; a cellular antenna; a GPS antenna and a GPS receiver communicatively coupled to the GPS antenna; a battery coupled to a sense circuit and operable to power the PSAD; a quick release switch operable to provide a signal indicating an occurrence of a one-stroke activation of the quick release switch by a user; an alarm operable to provide a loud warning sound; and a microcontroller including one or more processors and memory, where the microcontroller is operatively coupled to hardware components of the device, and where the microcontroller is configured with an operating system and software components, the software components including software configured to control the hardware components of the PSAD and perform operations. The operations include: communicating with the mobile telephone carrier to determine a cellular location of the PSAD; receiving GPS location information from GPS satellites to determine a GPS location of the PSAD, the GPS location being a higher precision location than the cellular location; maintaining state information as to a current state of the PSAD, the current state being one of a plurality of states that include an inactive state and an alarm state, the initial and default state of the PSAD being the inactive state; maintaining the PSAD in ultra-low power consumption while the PSAD is in the inactive state; receiving from the quick release switch an indication indicating that the quick release switch has been activated and in response change the state of the PSAD to the alarm state and provide normal power to all of the PSAD; maintaining ultra-low power consumption of the battery during the inactive state and switching to normal power during the alarm state; providing an alarm notification to an alarm monitoring center, the alarm notification including information identifying the PSAD; providing a cellular location notification to the alarm monitoring center, the cellular location notification including information identifying a current cellular location of the PSAD; providing a GPS location notification to the alarm monitoring center, the GPS location notification including information identifying a current GPS location of the PSAD; causing the PSAD to enter the inactive state if the user cancels the alarm within the delay period; and causing the PSAD to send, in one or more messages to the alarm monitoring center, an alarm notification that includes information identifying the PSAD and a current alarm instance, a cellular location notification, and a GPS location notification, when the current cellular location and the current GPS location are available, respectively.

This specification uses the term "configured" in connection with systems, apparatus, and computer program components. For a system of one or more computers to be configured to perform particular operations or actions means that the system has installed on it software, firmware, hardware, or a combination of them that in operation cause the system to perform the operations or actions. For one or more computer programs to be configured to perform particular operations or actions means that the one or more programs include instructions that, when executed by data processing apparatus, e.g., the data processing components of a portable personal security device, cause the apparatus to perform the operations or actions. For special-purpose logic circuitry to be configured to perform particular operations or actions means that the circuitry has electronic logic that performs the operations or actions.

The foregoing and other embodiments can each optionally include one or more of the following features, alone or in combination. In particular, one embodiment includes all the following features in combination.

The operations further include: providing a delay period for the user to cancel the alarm; determining that the user has not canceled the alarm during the delay period; and causing the PSAD to send a message to the alarm monitoring center after the delay period, the message indicating that the user has not canceled the alarm. The operations further include: receiving a false alarm check trigger from the alarm monitoring center; autonomously providing, without user intervention, a confirmation of the alarm state; upon receiving a false alarm input to the PSAD, confirming a false alarm, transitioning the state of the PSAD to the inactive state, canceling additional alarm-related notifications, and sending, to the alarm monitoring center, a message indicating that the alarm is false; upon receiving no user interrupt within a time period, providing a notification to the alarm monitoring center indicating a true alarm; upon receiving a duress input, providing a notification to the alarm monitoring center indicating a true alarm and that the user has entered the deceptive continue interrupt input under duress; and determining and sending GPS location coordinates at fixed intervals indicating the current location of the PSAD. The PSAD further includes a keypad communicatively coupled to the microcontroller and operable to receive user input, and the operations further include: receiving a PIN input on the keypad; determining that the PIN input matches a secret PIN stored on the PSAD and as a consequence transitioning the PSAD to the inactive state; and determining that the PIN input matches a secret duress PIN and as a consequence determining that the PSAD should remain in the alarm state and the alarm should be silenced. The operations further include providing an alarm cancellation notification. The operations further include disconnecting the battery from the battery-powered components of the PSAD, except the sense circuit, while the PSAD is in the inactive state. The alarm notification, the cellular location notification, and the GPS location notification is provided in the form of one or more text messages, data messages, or voice messages to the alarm monitoring center. The operations further include performing a battery test prior to transitioning the PSAD into the alarm state, and canceling the transitioning if the battery test indicates that the battery has a charge below a pre-defined threshold. Both the cellular antenna and the GPS receiver boot up simultaneously upon receipt of the battery voltage. The mobile telephone carrier is an LTE (Long Term Evolution) cellular carrier. The PSAD further includes one or more processors operable to execute the software components and instructions of the PSAD. The software components include: a main application operable to invoke, using a broker, other applications. The other applications include: a device registration and provisioning component operable to communicate, using a web application, with a web-based device registration service to complete registration of the PSAD, where information used during the registration includes at least a device identifier of the PSAD, a name of the user, a contact phone number of the user, and contact information for one or more other contacts of the user; a cellular component that includes instructions for communicating with the mobile telephone carrier and determining the cellular location of the PSAD; a GPS monitor that includes instructions for performing actions of the GPS receiver and determining the GPS location; a sense system component that includes instructions for performing actions of the sense circuit; and a communication component that includes instructions for communicating with the alarm monitoring center. The operations further include: receiving a user input requesting a network test of cellular and GPS functionality of the PSAD; providing normal power to network test components of the PSAD; transitioning the PSAD to a powered-up inactive state; initiating the network test including a GPS test and a cellular test; providing an indication of an outcome of the network test to the user; and transitioning the PSAD to the inactive state. The PSAD further includes a network test button, and the user input requesting the network test is a pressing of the network test button for a predetermined period; or the PSAD further includes a keypad user interface, and the user input requesting the network test is an input on the keypad user interface. The outcome of the network test is provided using a display, LEDs of different colors, or both. The PSAD further includes a housing covering components of the PSAD while exposing the quick release switch. The PSAD further includes a battery low indicator connected to the battery and operable to determine a current charge of the battery and indicate, using LEDs of different colors, whether the battery is sufficiently charged or in need of a charge. The PSAD further includes a flash memory operable to be written to over a universal serial bus (USB) or similar interface. The PSAD further includes a power management component that is controlled autonomously by a power management application residing on the microcontroller, where the power management component is managed through handshaking between the sense circuit, user interrupts, and acknowledgement or enable signals that determine when a specific action is completed that necessitates the PSAD to be transitioned to the inactive state. The operations of the microcontroller are performed without requiring a secondary device to respond to an alarm. The PSAD is not in a continuous on state, enabling privacy protection and postposing transmission of data until a trigger is received to activate the PSAD.

The subject matter described in this specification can be implemented in particular embodiments so as to realize one or more of the following advantages.

The use of a release control, e.g., a pull pin or other quick release switch, can prevent attackers from easily canceling an alarm while the noise from the alarm can continue to draw attention. A standalone device can connect to an monitoring center immediately, unlike a device that connects to a smart phone, which may be slow to connect. A standalone device that only needs to perform its communication functions when engaged can have a much longer battery life than a device that draws power to perform multiple functions. Sending a GSM location can be 19 times faster than sending a GPS location in limited connectivity zones, which can improve emergency response times by 19 times over a GPS-only model. The device can provide power management, including using extreme low power consumption using an always on sense circuit and, until the device's alarm is activated, an always off cellular connection, GPS connection, and alarm circuits. This can provide a high level of battery availability and can guard against privacy breaches and tracking. The device can provide a fully autonomous work stream that is triggered by a single action. The device can be asynchronously machine-driven, using a strong interaction with a backend control station and server. The interaction can include handshaking protocols and can use an MQTT (MQ Telemetry Transport) broker software application designed to perform all functions without requiring user intervention. The device can provide full availability of prevention, with notification and response, using standalone connectivity and without reliance on a secondary cellular device or network connectivity. System implementation of the device can provide a swift response mechanism in which cellular coordinates are released immediately, followed by GPS precision coordinates that speed a response mechanism.

The details of one or more embodiments of the subject matter of this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This specification describes a portable personal security device that includes an emergency alarm that is loud enough to attract attention and deter an attacker. Because it is a stand-alone device, the portable personal security device has ultra-low power consumption until the alarm is activated, resulting in extended battery life. Consequently, the user is assured that the portable personal security device is ready to function in an emergency situation, to connect appropriately and quickly to notify an emergency responder or notify personal emergency contacts, while providing adequate location information.

Figure 1A:
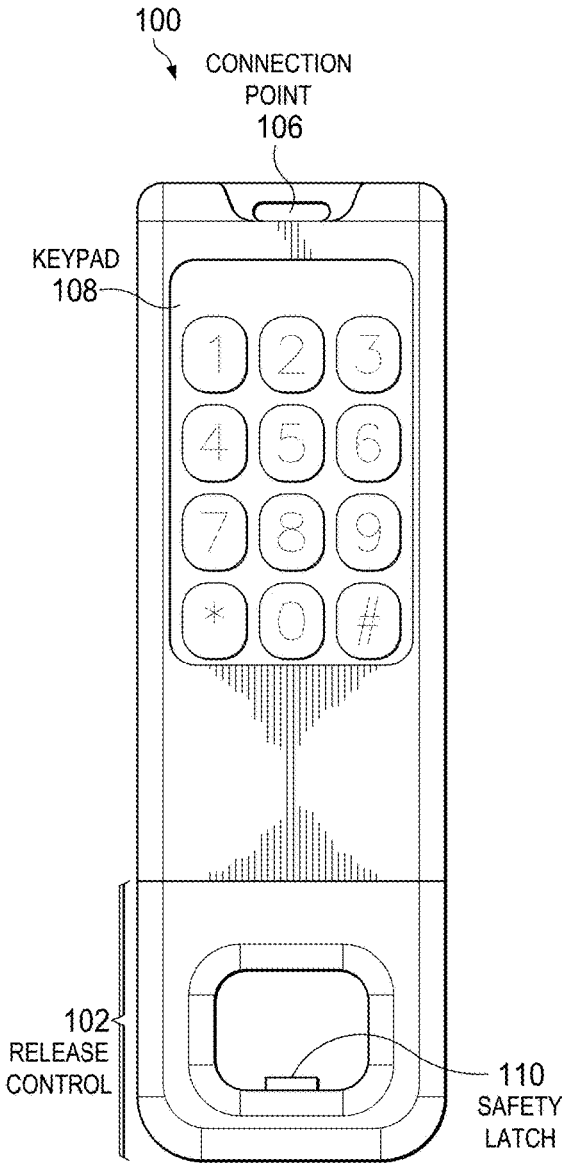
FIG. 1A is a front view of the PSAD.
Figure 1B:
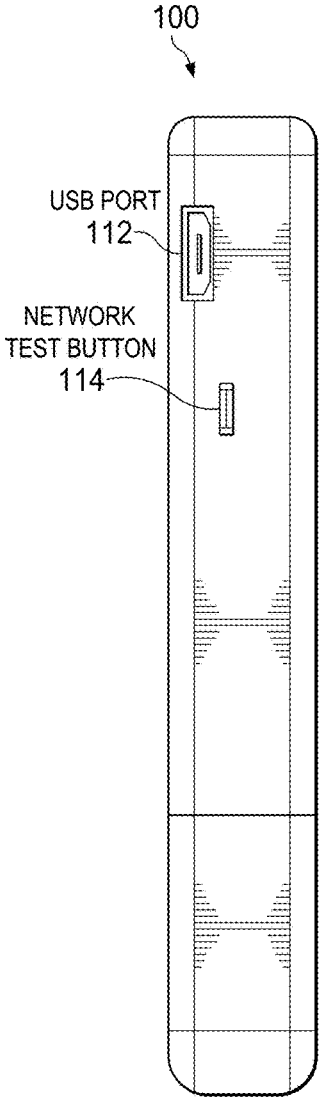
FIG. 1B is a side view of the PSAD.

FIG. 1A is a front view of the portable personal security device (PSAD) 100. FIG. 1B is a side view of the PSAD 100. The PSAD 100 includes a release control 102, e.g., a pull pin, that serves as a quick release switch. When a user activates the release control 102, a sense circuit inside the PSAD senses the activation and provides a signal that triggers other components in the PSAD 100 to identify the geographic location of the PSAD 100 and contact an alarm monitoring center. An alarm cover covers and protects the operating components of the PSAD 100. A connection point 106 provides a location on the PSAD 100 to which a strap or a clasp can be connected, e.g., to a lanyard, or used with a loop of material to be tied to a belt loop, a handbag strap, or the like. A keypad 108 on the PSAD 100 allows entry of user input, e.g., a personal PIN (personal identification number) that the user can define and use for authentication, including during a cancelation of the alarm, e.g., in a false alarm situation. A safety latch 110 prevents inadvertent activation of the PSAD 100, as the release control 102 cannot be pulled unless the safety latch 110 is first depressed. An example width of the PSAD 100 is 36.75 mm. An example depth of the PSAD 100 is 17.7 mm. An example height of the PSAD 100, not including the release control, is 63 mm. An example height of the release control 102, is 25.4 mm. A USB (universal serial bus) port 112 on the PSAD 100 provides a port for charging the battery of the PSAD 100. A network test switch 114 on the PSAD 100 provides a control for the user to initiate a network test of the PSAD 100.

Figure 1C:
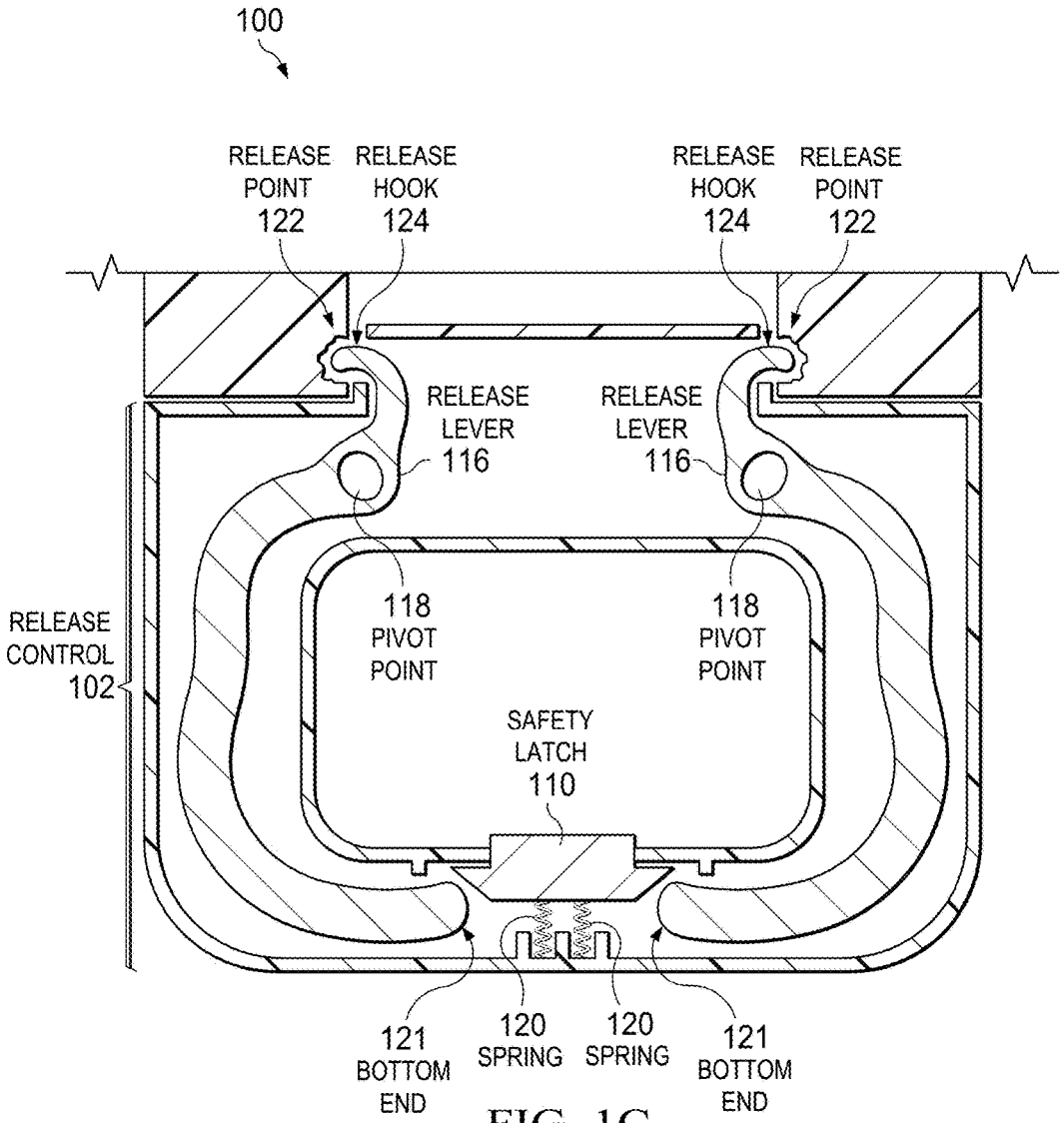
FIG. 1C is a front view of a release control of the PSAD.

FIG. 1C is a detailed front view of the release control 102. The release control 102 includes release levers 116 that are operable to pivot on pivot points 118. The position of the release levers 116 depends on whether the safety latch 110 is pressed. Springs 120 or other mechanisms can hold the safety latch 110 in place during the inactive state of the PSAD 100, helping to prevent inadvertent activation of the release control 102. The safety latch 110, when pressed to activate an alarm, can push against bottom ends 121 of the release levers 116. This causes the release levers 116 to pivot on pivot points 118. As a result, release hooks 124 on the release levers 116 disengage from release points 122 on the PSAD 100. This allows separation of the release control 102 from the rest of the PSAD 100.

Figure 2:
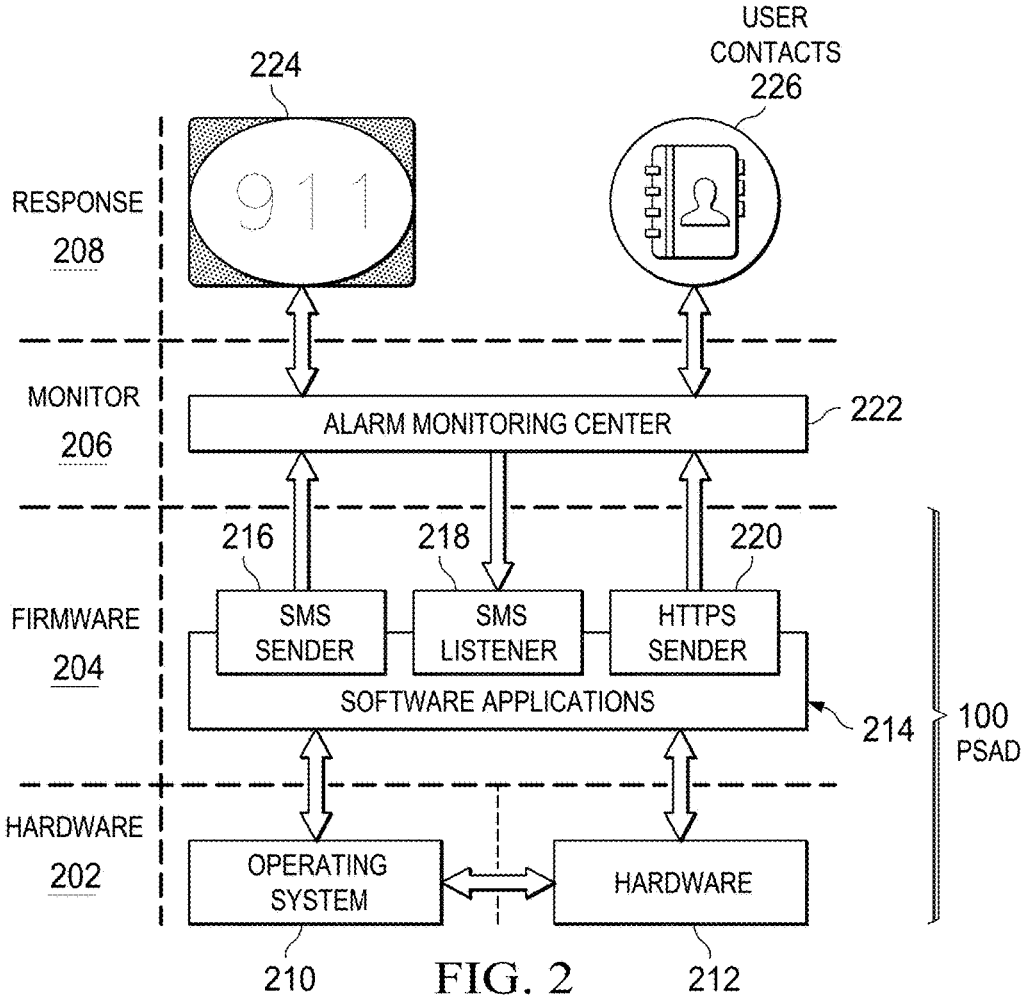
FIG. 2 is a block diagram showing flows of information and actions that can occur when a user activates the PSAD.

FIG. 2 is a block diagram showing flows of information and actions that can occur when a user activates the PSAD 100. The flows of information and actions can occur within and between adjacent levels that include a hardware level 202 and a firmware level 204, which are part of the PSAD 100, a monitor level 206, which is generally an alarm monitoring center, and a response level 208, which covers actions performed by responders to assist the user.

The hardware level 202 includes an operating system 210, e.g., a Linux operating system, in the PSAD 100 and the hardware 212 components of the PSAD 100. The hardware components includes a microcontroller 318 (FIG. 3A) on which the operating system runs. At the firmware level 204, software components, which in some implementations are applications running on top of the operating system, control the operation of the PSAD 100. In some implementations, the software applications 214 include an SMS (Short Message Service) sender 216, an SMS listener 218, and an HTTPS (Hyper Text Transfer Protocol Secure) sender 220 that provide communications between the software applications 214 and an alarm monitoring center 222. An example communication is a notification sent to the alarm monitoring center 222 that the user has activated an alarm.

The alarm monitoring center 222 communicates with an emergency response center 224, e.g., a 911 monitoring center, a police department, a security company service center, or some other 24×7 emergency response entity. An example communication from the alarm monitoring center 222 is a voice or text message to a 911 center that "User X at Location Y has an emergency and needs assistance." The alarm monitoring center 222 also communicates with one or more user contacts 226 to be contacted in the event of an emergency. The PSAD 100, when delivered to the user, is preconfigured to communicate with the alarm monitoring center 222.

Figure 3A:
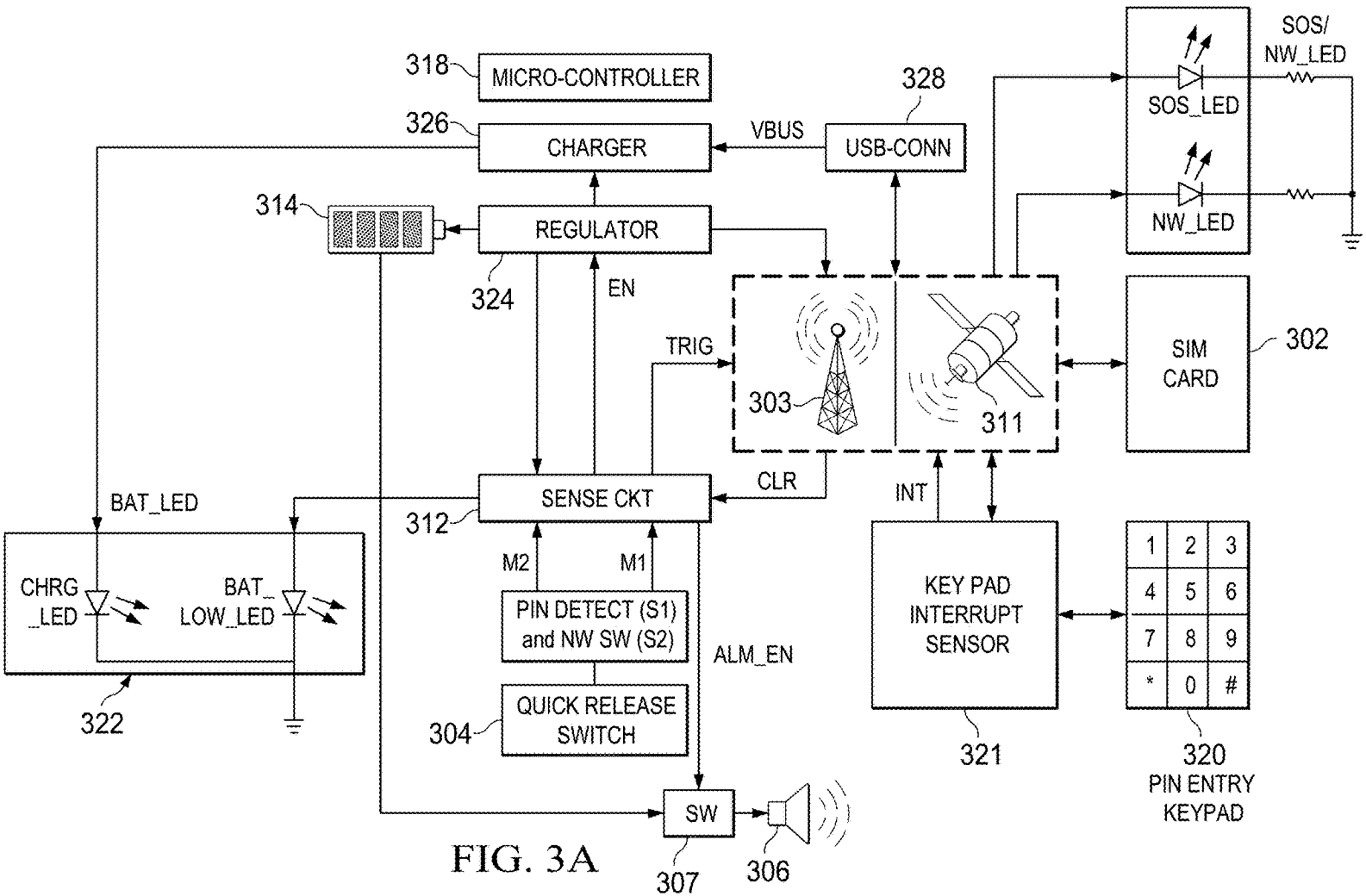
FIG. 3A is a block diagram showing hardware components of an example implementation of a PSAD.

FIG. 3A is a block diagram showing hardware components of an example implementation of a PSAD 100. These hardware components correspond to hardware 212 of FIG. 2. The hardware includes a subscriber identification module (SIM) card 302 that stores at least an international mobile subscriber identity (IMSI) number and a related key. The IMSI number and the related key, when used together, identify the PSAD 100 to a mobile telephone carrier. The mobile telephone carrier can be a GSM (Global System for Mobile communication) cellular carrier. In some implementations, the PSAD 100 can be configured to accept the user's SIM card from another device.

A quick release switch 304 is coupled to the release control 102 and provides an activation signal when the user activates the release control 102. At that time, an alarm switch 307 receives the signal and triggers an alarm 306, which makes a loud, e.g., 130 dB, sound. Until the quick release switch 304 is activated by the user or other user action is taken on the device, the PSAD 100 remains in an ultra-low power consumption state.

A sense circuit 312 is communicatively coupled to the quick release switch 304 and the alarm 306. The sense circuit 312 maintains state information as to a current state of the PSAD 100, where the current state can be an inactive state or an alarm state. The initial and default state of the PSAD 100 is the inactive state. The sense circuit 312 maintains the PSAD 100 in ultra-low power consumption while the PSAD 100 is in the inactive state. When a user activates the PSAD 100, e.g., by activating the release control 102, the sense circuit 312 receives an indication from the quick release switch 304 indicating that the quick release switch 304 has been activated. In response to receipt of the indication, the sense circuit 312 changes the state of the PSAD 100 to the alarm state and provides normal power to all of the PSAD 100.

A battery 314 is coupled to the sense circuit 312. When the PSAD 100 is in the inactive state, the sense circuit 312 maintains ultra-low power consumption of the battery 314. The sense circuit 312 switches to normal power during the alarm state. In some implementations, the battery 314 is rechargeable. A charger 326 obtaining power through a USB port 328 or other external source recharges the battery 314. An external power source, e.g., a charger or a laptop computer, connected to the USB port 328 can be used to charge the battery 314.

The sense circuit 312 is also communicatively coupled to circuitry that manage cell communications 303 and GPS location 311 operations. Modules that include such circuitry include, for example, the Sierra Wireless WP7603-1 cellular module and the Sierra Wireless WP7700 cellular module.

In some implementations, the PSAD 100 includes a keypad 320. The keypad 320 is communicatively coupled to the microcontroller 318 and can receive user inputs from the user which cause the PSAD 100 to perform actions based on the user inputs.

In some implementations, the PSAD 100 includes a network test button coupled to the sense circuit 312, and the user input requesting the test can be a pressing of the network test button. In another example, the PSAD 100 includes a keypad user interface, e.g., using the keypad 108, coupled to the sense circuit 312, and the user input requesting the test can be an input on the keypad user interface, e.g., a key sequence such as "T-E-S-T" or "1-2-3" that is predefined to initiate the test. The sense circuit 312 can control the operations of the test. The sense circuit 312 can provide an indication of the result of the test using one or more LEDs (Light-Emitting Diodes) of different colors, e.g., green=success and red=failure. In some implementations, the indication can be provided using an audible sound that is provided by the PSAD 100.

In some implementations, the PSAD 100 includes a housing that covers components of the PSAD 100. The housing can cover the PSAD 100 while still exposing the release control 102 that serves as the quick release switch 304.

In some implementations, the PSAD can also include a regulator 324 connected between the battery 314 and battery-powered components of the PSAD 100 and operable to maintain a constant voltage level between the battery 314 and the battery-powered components of the PSAD 100.

In some implementations, the PSAD 100 can also include a battery low indicator 322 connected to the battery 314. The battery low indicator 322 can determine a current charge of the battery 314 and can indicate, using LEDs of different colors, whether the battery 314 is sufficiently charged or needs a charge.

In some implementations, the PSAD 100 includes a flash memory that can be written to over a USB or similar interface. The flash memory can store network and device configuration information, the user's secret PIN, the user's secret duress PIN, GPS almanac data, and GPS ephemeris data.

The PSAD 100 can use the secret PIN for user authentication. During the alarm state and upon confirmation that the user is a registered user of the PSAD 100 based on input of the secret PIN, the PSAD 100 can transition to the inactive state and provides an alarm cancellation notification for display on the keypad 320. In some implementations, the keypad 320 or another physical device of the PSAD 100 can be used by the user to input and display text, e.g., specific information input by the user regarding an emergency situation and to display messages received from the alarm monitoring center 222.

In some implementations, other alarm features can exist. Other alarm features can include, e.g., strobe lights, audible features in addition to the alarm, and visual features. In some implementations, the user can designate which alarm features are to be configured for the user's PSAD 100.

Figure 3B:
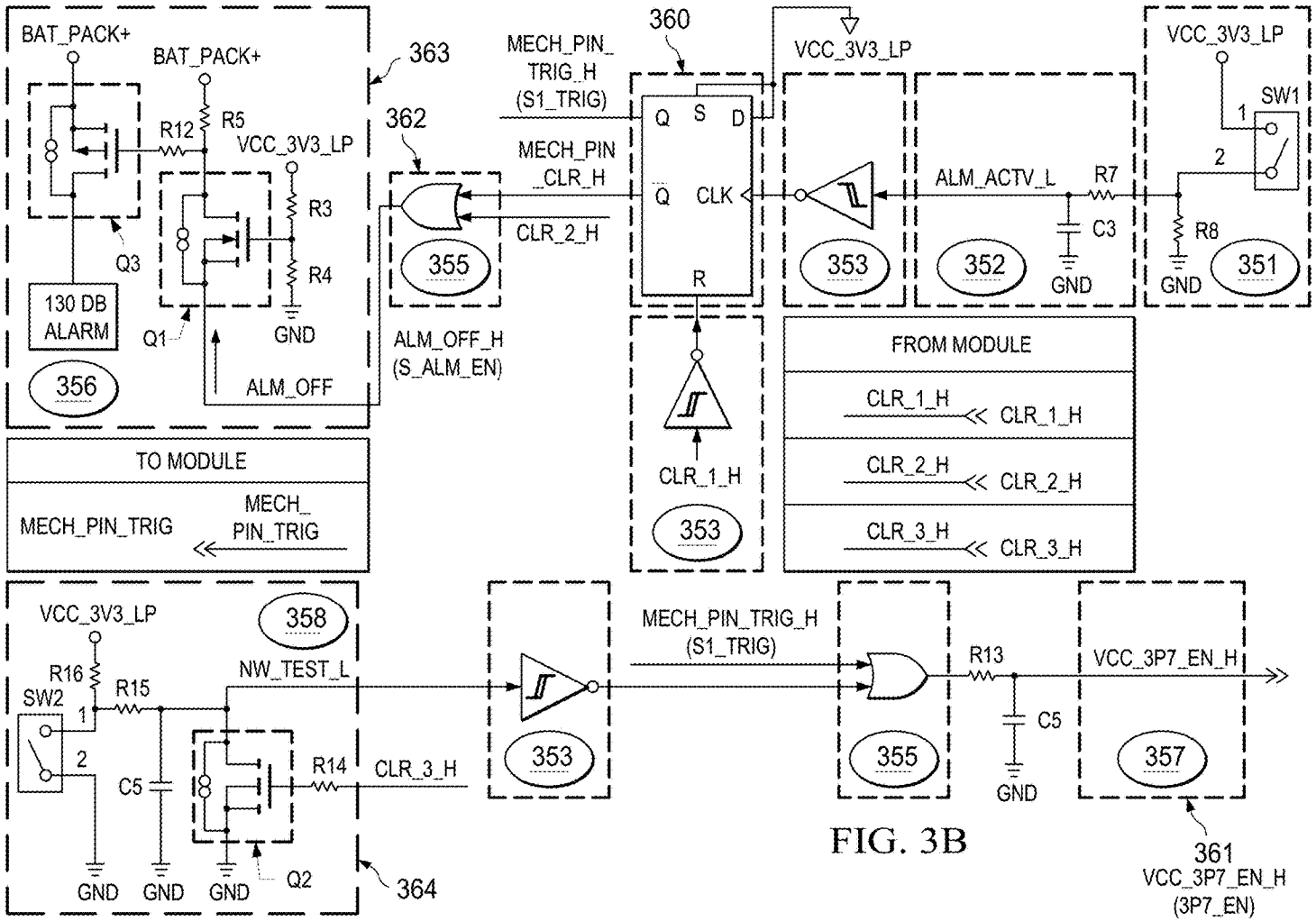
FIG. 3B is a schematic of an implementation of a sense circuit.

FIG. 3B is a schematic of an example implementation of a sense circuit. This circuit can be used as sense circuit 312 shown in FIG. 3A. The sense circuit makes it possible for the PSAD 100 to maintain ultra-low power consumption during the inactive state while being ready to respond to an indication of the quick release mechanism. At 351, a pin detect switch is normally in closed state as long as the pull pin is in place. When the release control is activated, e.g., the pull pin is removed, a pin detect switch generates a HIGH signal. After inversion, the signal generates a high going edge at a clock pin on a D-type flip-flop 360.

At 352, a debouncer circuit filters out bounces and provides, as output, meaningful high or low states to other digital circuits.

At 353, an inverter with a Schmitt trigger provides, as output, an output transition at a rate that is compatible with digital circuits.

At 354, the D-type flip-flop 360 is used as a memory element. The output from the inverter triggers the flip-flop 360. The memory remembers the state and will not change even if the mechanical pin is replaced. The output of the flip-flop 360 can independently trigger the alarm. The flip-flop 360 can also turn off the entire circuitry when cleared by the inverter with a Schmitt trigger.

At 355, logic 362 triggers the alarm through the pin detect switch or clears the alarm without turning off the LTE (Long Term Evolution) module in case of a TRUE-ALARM event.

At 356, a translator 363 translates a battery voltage logic level to a 3.3 volt logic level.

At 357, the LTE module 361 enables delivery of power to the LTE module either through the pin detect switch or a network test switch.

At 358, a network test key timer and debouncer 364 tunes the time for which a switch is to be pressed to run a network availability test. The network test key timer and debouncer 364 also serves as a debouncer circuit. The output of the network test key timer and debouncer 364 goes to the inverter with Schmitt trigger for improving the transition rates.

Figure 4:
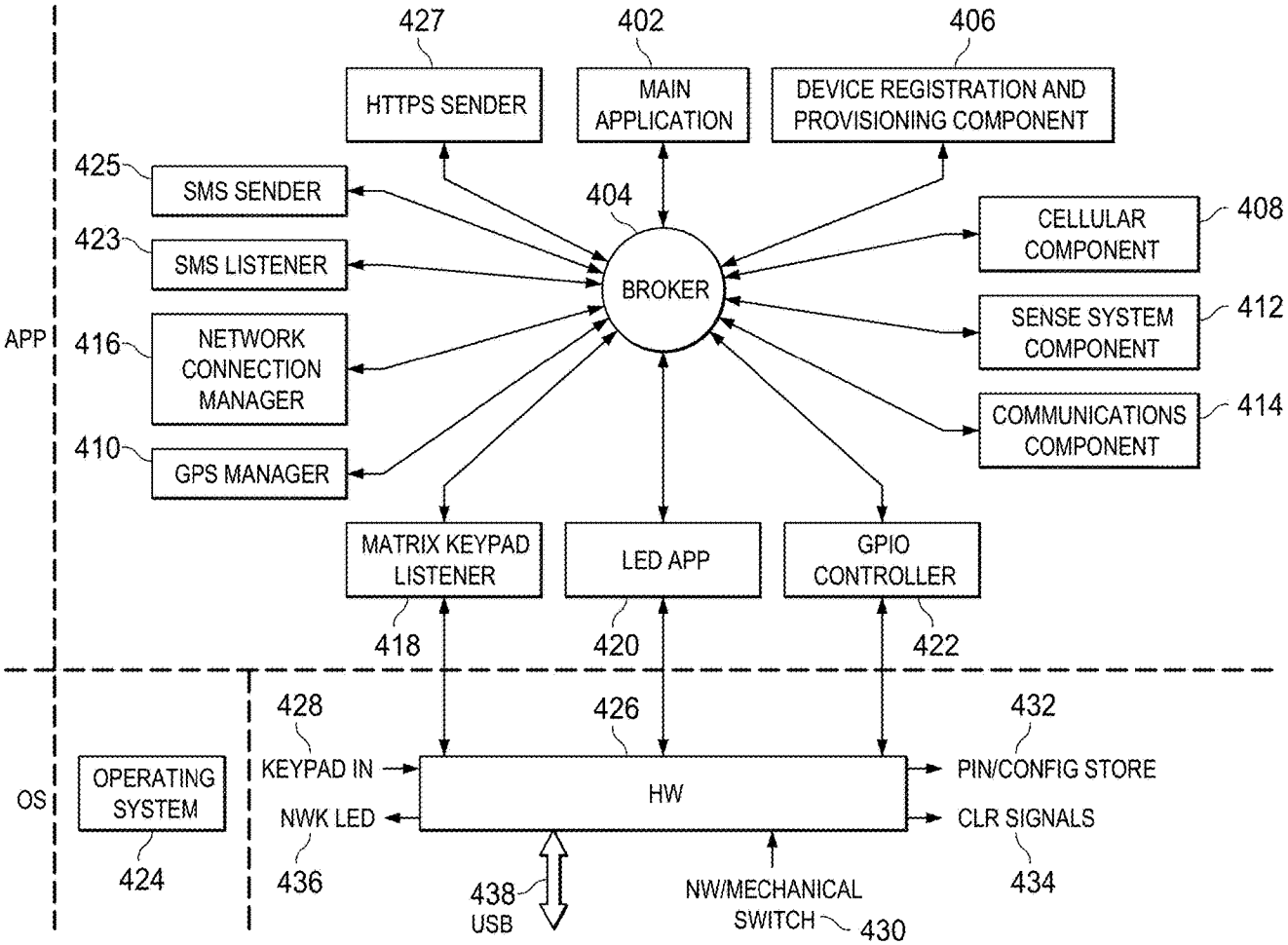
FIG. 4 is a block diagram showing software components of an example implementation of software in the PSAD.

FIG. 4 is a block diagram showing software components of an example implementation of software in the PSAD 100. The software components include multiple applications that execute on top of an operating system, e.g., Linux. Each of the applications handles key discrete functions. A main application 402 includes core logic. In the implementation being described, the main application 402 uses an off-the-shelf MQTT (MQ Telemetry Transport) broker. The applications use the broker to exchange messages with each other. Each application has an MQTT client, and each application publishes and subscribes defined topics to exchange messages with each other using the MQTT broker. A few applications interact with hardware by receiving signals from the hardware or by driving signals to the hardware, including keyboard inputs, network test LED signals, and clear signals.

A device registration and provisioning component 406 communicates, e.g., using a web application, with a web-based device registration service to complete registration of the PSAD 100. Information used during registration includes at least a device identifier of the PSAD, a name of the user, a contact phone number of the user, and contact information for one or more other contacts of the user. Information used during registration can also include configuration settings provided by the user for configuring the user's PSAD 100.

In some implementations, the web-based device registration service includes a user interface that facilitates user input of registration information for the PSAD 100. The registration information includes, e.g., a device ID of the PSAD 100, a name of the user, a user ID associated with registration, one or more phone numbers for contacting the user, a county of residence of the user, and security information including questions and answers for authenticating the user in case of a password reset or for other purposes. The registration information also facilitates user input of the user's secret PIN, the user's secret duress PIN, and personal emergency contact information, including phone numbers. In some implementations, registration information includes purchase information, identifying the purchase location and date of purchase of the PSAD 100. Registration can include the presentation of an agreement for terms and service and can require user acceptance of the agreement. The user interface can include a submit button that, when pressed by the user, causes the web-based device registration service to send the registration information to the alarm monitoring center. The registration information can also be saved in a database on a server that is associated with the web-based device registration service. Registration information can be retained as long as the user's PSAD 100 is registered.

In some implementations, the USB port 112 can be used for registration of the PSAD 100 and for configuration updates, e.g., software updates to applications on the PSAD 100. In some implementations, the web-based device registration service can email registered users when updates are available. Emailed instructions can include steps for connecting the PSAD 100 to the USB port 112 and can describe the process for completing the updates. The process description can identify indications shown on LEDs of the PSAD 100 and notifications presented in the user interface that indicate progress and completion of the process. Emailed instructions associated with updating the user's PINs can include step-by-step actions to be performed by the user. Steps that are provided to the user can include instructions for connecting, e.g., through a browser, to the web-based device registration service and power up procedures for the PSAD 100.

A GPS (global positioning system) manager 410 includes instructions for using information received from the GPS satellites to determine a current GPS location based on the information. The GPS manager 410 includes instructions for using a GPS antenna and a GPS receiver communicatively coupled to the GPS antenna. Generally, the GPS location provided by the GPS manager 410 is typically a higher precision location than the cellular location provided by the cellular component 408. In some implementations, the GPS manager 410 uses information from one or more of GPS almanac data and GPS ephemeris data. The GPS almanac data and GPS ephemeris data can be pre-stored on the PSAD 100 for faster processing during an alarm. In some implementations, the cellular antenna and the GPS antenna can be the same antenna. In some implementations, the GPS receiver can be disconnected from the antenna while the cellular component 408 is transmitting. Alternatively, one antenna can be used as the cellular antenna and an active antenna can be used for the GPS receiver.

A communications component 414 includes software that communicates with entities outside the PSAD 100. The communications component 414 provides an alarm notification to the alarm monitoring center 222. The alarm notification includes information identifying the PSAD 100. The communications component 414 also provides a cellular location notification to the alarm monitoring center 222. The cellular location notification includes information identifying a current cellular location of the PSAD 100. The communications component 414 also provides a GPS location notification to the alarm monitoring center 222. The GPS location notification includes information identifying a current GPS location of the PSAD 100.

In some implementations, the communications component 414 can handle the cancelation of a false alarm. The communications component 414 can receive a false alarm check notification from the alarm monitoring center 222. The communications component 414 can provide a false alarm confirmation prompt for presentation on a display of the PSAD 100. Upon receiving a user response to the false alarm confirmation prompt that confirms a false alarm, the communications component 414 can change the state of the PSAD 100 to the inactive state, cancel additional alarm-related notifications, and send, to the alarm monitoring center 222, a message indicating that the alarm is false. Otherwise, upon receiving a user response to the false alarm confirmation prompt that indicates a true alarm or upon determining that no user response to the false alarm has been received within a threshold time period, the communications component 414 can send, to the alarm monitoring center 222, an alarm confirmation notification indicating that the alarm is not false. During the time in which false alarm-related messages are being sent and received, the communications component 414 can send and receive non-alarm-related notifications not related to notifications of the alarm state. The alarm monitoring center 222 should assume that the alarm is real if no cancellation is received.

In some implementations, the communications component 414 can provide the alarm notification, the cellular location notification, and the GPS location notification in the form of one or more text messages or speech messages or both to the alarm monitoring center 222. A text message or a speech message can occur upon determining that the alarm has been activated, e.g., indicating "Alarm has been activated". Other notifications include messages sent to the alarm monitoring center 222 that include an initial message that indicates that an alarm has been activated, a message that includes a current cellular location of the PSAD 100, a message that includes a current GPS location of the PSAD 100, and, if the user cancels the alarm, a message that indicates that the alarm is a false alarm.

The PSAD 100 enters the inactive state when the user cancels the alarm within the delay period. The communications component 414 sends an alarm notification to the alarm monitoring center 222. The alarm notification includes one or more messages that may be sent separately. The alarm notification includes information identifying the PSAD 100 and a current alarm instance, a cellular location notification, and a GPS location notification, when the current cellular location and the current GPS location are available, respectively.

In some implementations, one or more delay periods are implemented for managing timing of events and communications regarding the PSAD 100. The delay period can be, e.g., a few seconds, allowing the user to cancel the alarm. A delay period can occur before one or more messages are sent to the alarm monitoring center 222.

In some implementations, one or more delays associated with non-cancellation of the alarm by the user can be implemented. The PSAD 100 can determine that the user has not canceled the alarm during the delay period. Then, the PSAD 100 can cause a delay period to occur before a message is sent to the alarm monitoring center 222 indicating that the user has not canceled the alarm.

In some implementations, a battery test can be performed prior to transitioning the PSAD 100 into the alarm state. The transition can be canceled, e.g., if the battery test indicates that the battery 314 has a charge below a pre-defined threshold.

In some implementations, the PSAD 100 includes one or more processors that can implement components of the PSAD 100 and execute instructions of applications of the PSAD 100.

In some implementations, the PSAD 100 can perform network test operations, e.g., to determine cellular and GPS connectivity. The PSAD 100 can receive a user input requesting a network test for testing the cellular and GPS connectivity of the PSAD 100. In response, the PSAD 100 can provide normal power to network test components of the PSAD 100, transition the PSAD 100 to a powered-up inactive state, initiate the network test including a GPS test and a cellular test, provide an indication of the outcome of the network test to the user, and transition the PSAD 100 to the inactive state.

A matrix keypad listener application 418 monitors for interrupts from a keypad decoder, e.g., an Analog Devices ADP5585, that is coupled to the keypad 108 (FIG. 1A). During interrupt processing, the matrix keypad listener application collects keystrokes and validate the keystrokes against the stored PIN numbers. The matrix keypad listener application publishes messages related to PIN1/PIN2 and matches events which are subscribed to by the main application 402.

An LED application 420 subscribes to LED-related messages published from the main application 402. Depending upon received LED messages, the LED application causes the NWK (network) LED to glow solid green or red. Depending upon received LED messages, the LED application causes the emergency LED to glow blinking red or blinking green.

A GPIO (general purpose input-output) controller 422 can be any suitable function-non-specific controller. The GPIO controller 422 is operable to process inputs from the sense circuit 312 and send outputs to the communications component 414. The GPIO controller 422 also monitors the mechanical PIN status signal and publishes the status of the signal to the main application 402.

An SMS listener application 423 monitors for SMS messages sent from the alarm monitoring center 222, including GPS location requests. The SMS listener application 423 publishes messages with content of the received SMS messages to the GPS manager 410.

An SMS sender application 425 subscribes to SMS send-related messages published from the main application 402. The SMS sender application 425 also manages an SMS send process.

An HTTPS sender application 427 subscribes to HTTPS send-related messages published from the main application 402. The HTTPS sender application 427 also manages the HTTPS data packet send process and subscribes to network status-related messages from a network connection manager application 416. The network connection manager application 416 manages the network connection process, including publish the network connection status based on network up/down status.

The GPS manager 410 publishes GPSLOC (GPS Location coordinate) messages. The GPS manager 410 also subscribes to GPSREQ (GPS Location Coordinate Request) messages from the SMS listener 423.

The main application 402 is the central application which implements core logic of the PSAD 100. The main application 402 initializes GPIO controller 422 and the keypad decoder at power up. The main application 402 subscribes to mechanical pin status messages from the GPIO controller 422. The main application 402 subscribes to PIN1/PIN2 match messages from the matrix keypad listener application 418. The main application 402 publishes clear (CLR) messages to the GPIO controller 422, which are used to drive the CLR1_H, CLR2_H, and CLR3_H signals. The main application 402 publishes LED messages to the LED application 420, which are used to drive the emergency/NWK LEDs. The main application 402 subscribes to GPSLOC (GPS Location coordinate) messages from the GPS manager 410. Using collected GPS coordinates, the main application 402 forms SMS send packets and publishes the send packets to the SMS send application. Using collected GPS coordinates, the main application 402 forms HTTPS data packets and publishes the HTTPS data packets to the HTTPS send application 427.

An operating system 424, e.g., Linux, can serve hardware components 426 of the PSAD 100. Inputs to the hardware components 426 include keypad inputs 428. Inputs to the hardware components 426 also include also switch inputs 430, e.g., inputs from the sense system that detects the pin pull. Outputs of the hardware components 426 include PIN and configuration information 432, clear signals 434 for canceling an alarm, and network LED signals 436, e.g., for displaying the status of a network test. Input/output signals include USB pins 438 that include an input to recharge a rechargeable battery of the PSAD 100 and an output for providing registration information, e.g., to another device that has a network to a registration website.

Figure 5A:
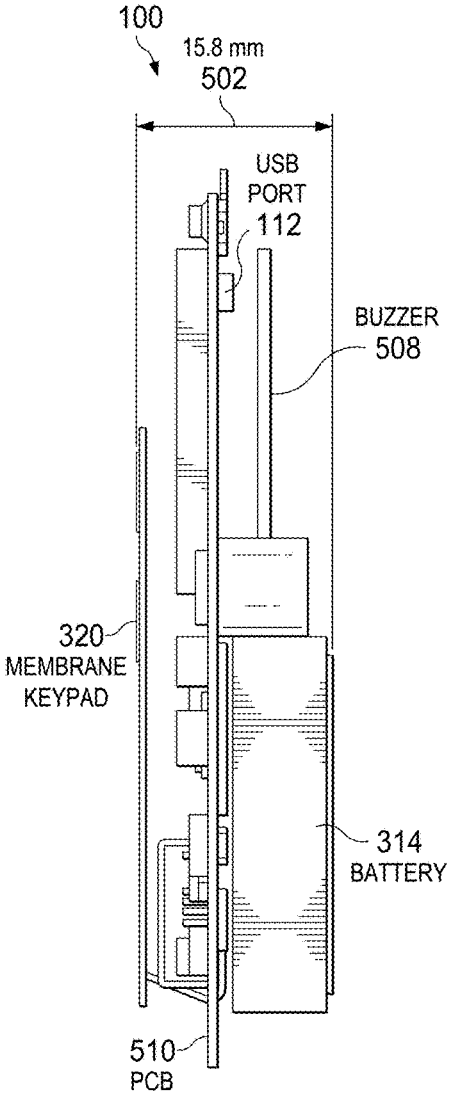
FIG. 5A is a cross-sectional view of inside components of the PSAD.
Figure 5B:
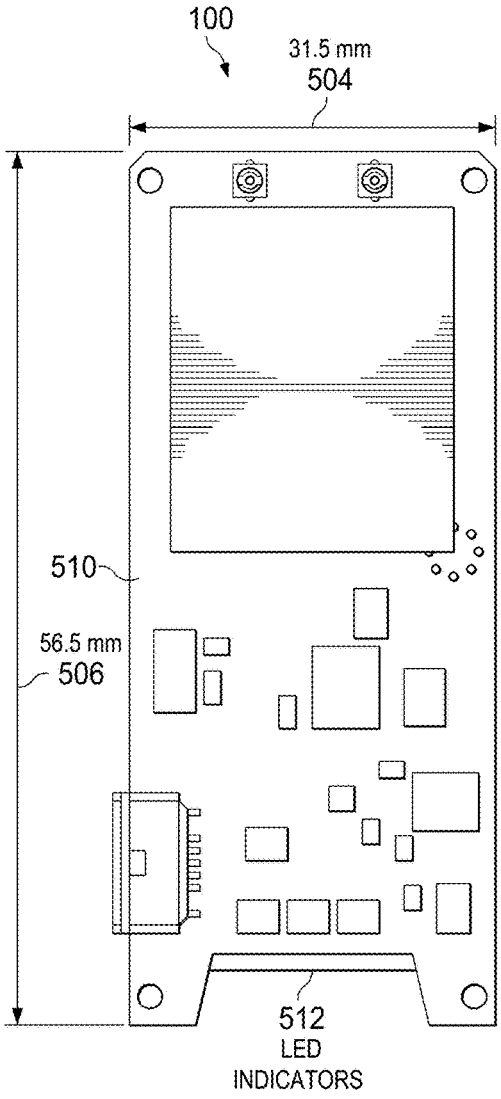
FIG. 5B is a back view of inside components of the PSAD.

FIG. 5A is a cross-sectional view of inside components of the PSAD 100. FIG. 5B is a back view of inside components of the PSAD 100. An example combined depth 502 of the inside components is 15.8 mm. An example combined width 504 of the inside components is 31.5 mm. An example combined height 506 of the inside components is 56.5 mm. The views of the PSAD 100 show example locations of a buzzer 508, the keypad 320, e.g., a membrane keypad, a PCB (printed circuit board) 510, the battery 314, and LED indicators 512.

Figure 6A:
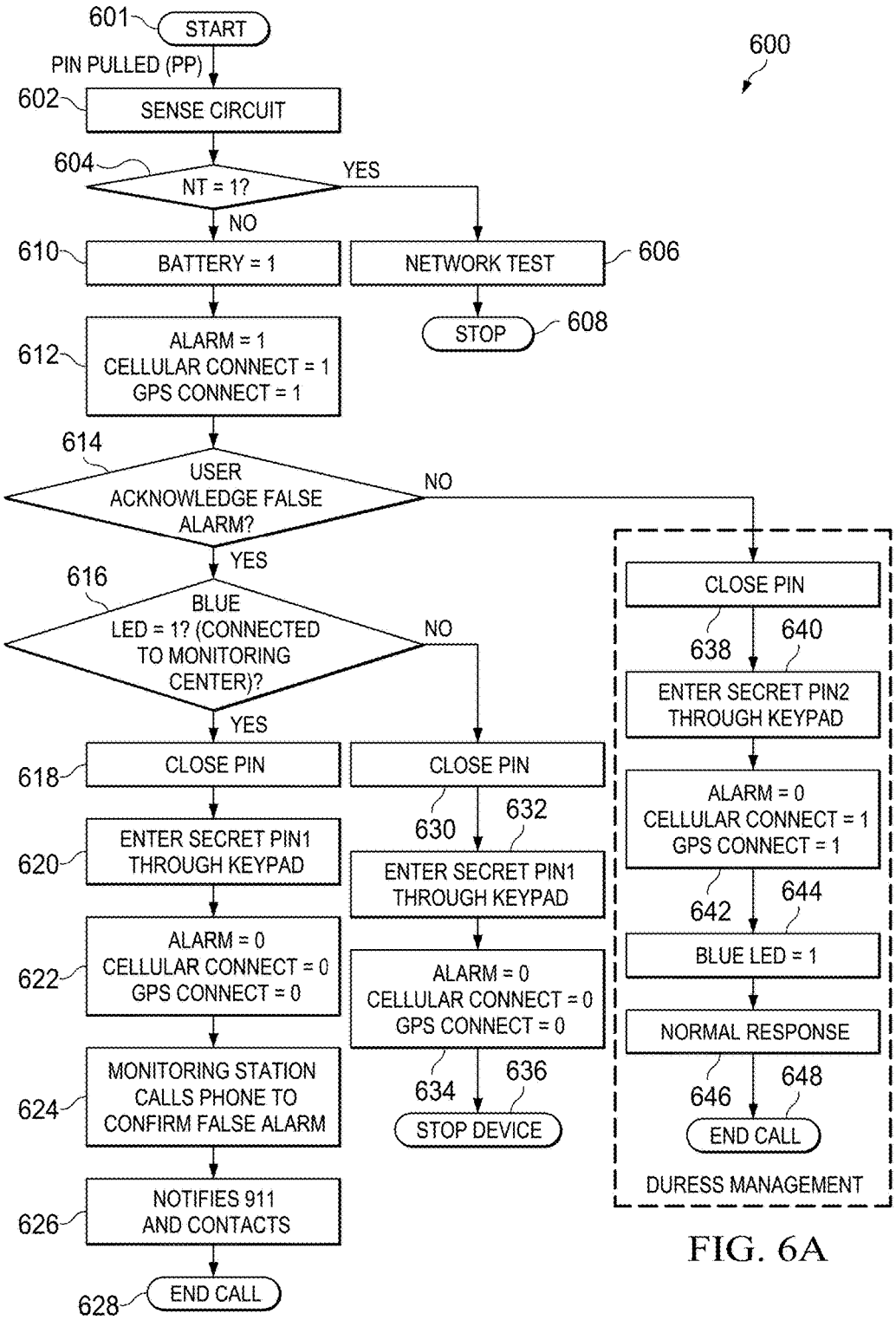
FIG. 6A is a flowchart of an example process for handling false alarms and duress management.

FIG. 6A is a flowchart of an example process 600 for handling false alarms and duress management. The PSAD 100, when appropriately programmed, can perform the process 600.

At 601, the device is in an inactive state and stays in the inactive state until an indication is received that the pin is pulled or that a network test is being performed. At 602, the sense circuit 312 receives an indication that the pin is pulled or that a network test is being performed. At 604, a determination is made as to whether the indication corresponds to a network test. At 606, if the indication corresponds to a network test, then a network test is performed, and the process stops at 608.

At 610, if the indication corresponds to a pulled pin, then the battery is turned on. At 612, alarm, cellular, and GPS connections are made. At 614, a determination is made as to whether the user is acknowledging a false alarm.

At 616, if the user is acknowledging a false alarm, a determination is made whether the blue LED is turned on, indicating a connection to the alarm monitoring center. At 618, if the PSAD 100 is connected to the alarm monitoring center, then the user replaces the release mechanism 102 as an initial step for initiating a false alarm. At 620, the user enters the secret PIN through the keypad. At 622, the alarm, cellular connection, and GPS connection are disconnected. At 624, the alarm monitoring center calls the user to confirm the false alarm. At 626, the alarm monitoring center notifies the emergency responder and personal emergency contacts of the user to indicate the false alarm. At 628, the calls are ended and process 600 stops.

At 630, if the PSAD 100 is not connected to the alarm monitoring center, then the user replaces the release mechanism 102 as an initial step for initiating a false alarm. At 632, the user enters the secret PIN through the keypad. At 634, the alarm, cellular connection, and GPS connection are disconnected. At 636, the process 600 stops.

At 638, if the user is signaling duress, e.g., in which the user is being forced, under duress, to turn off the alarm, the user first replaces the pin. At 640, the user enters a secret duress PIN that is different from the secret PIN. At 642, the alarm is turned off, but cellular and GPS connections are continued. At 644, the blue LED is turned on, indicating a connection to the alarm monitoring center. At 646, a normal response occurs. At 648, the call is ended, and the process 600 stops.

Figure 6B:
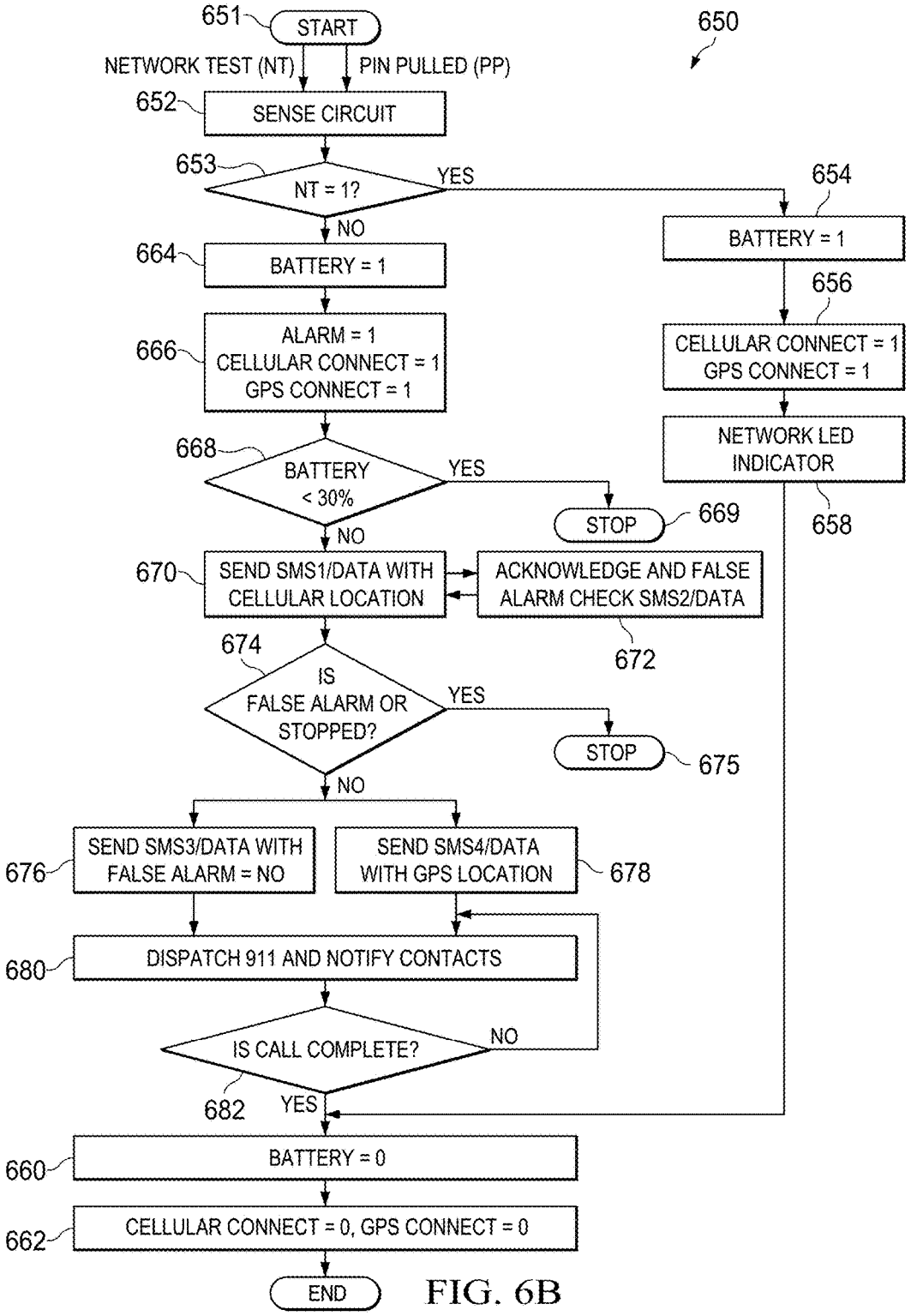
FIG. 6B is a flowchart of an example process for a normal alarm and response.

FIG. 6B is a flowchart of an example process 650 for a normal alarm and response. The PSAD 100, when appropriately programmed, can perform the process 650.

At 651, the device is in an inactive state and stays in the inactive state until an indication is received by the sense circuit. At 652, the sense circuit receives an indication that a network test is being performed or the pin has been pulled. At 653, a determination is made as to whether the indication corresponds to a network test.

At 654, if the indication corresponds to a network test, then the battery is connected. At 656, cellular and GPS connections are made. At 658, the network test LED indicates the result of the network test, e.g., green=success and red=failure. At 660, the battery is disconnected. At 662, cellular and GPS connections are disconnected.

At 664, if the indication corresponds to a pulled pin, indicating an alarm, the battery is connected. At 666, the alarm is sounded, and cellular and GPS connections are made. At 668, a determination is made whether the battery charge is below a threshold level, e.g., 30%. If the battery charge is below the threshold level, then the process 650 stops at 669.

At 670, if the battery charge is not below the threshold level, then a first message identifying a cellular location of the PSAD 100 is sent to the alarm monitoring center. At 672, the alarm monitoring center acknowledges the received message and sends a second message to the PSAD 100, initiating a false alarm check.

At 674, if a false alarm exists or if the alarm state is stopped, then the process 650 stops at 675. At 676, the PSAD 100 sends a third message, without user intervention, that indicates that there is no false alarm. At 678, the PSAD 100 sends a fourth message to the alarm monitoring center that includes the GPS location of the PSAD 100. At 680, the alarm monitoring center dispatches an emergency responder and notifies emergency contacts of the user. At 682, a determination is made whether the call is complete, and if so, then the battery is disconnected at 660.

Embodiments of the subject matter and the actions and operations described in this specification can be implemented in electronic circuitry, in tangibly-embodied computer software or firmware, in computer hardware, including the structures disclosed in this specification and their structural equivalents, or in combinations of one or more of them. Embodiments of the subject matter described in this specification can be implemented as one or more computer programs, i.e., one or more modules of computer program instructions encoded on a tangible non-transitory storage medium for execution by, or to control the operation of, data processing apparatus. Alternatively or in addition, the program instructions can be encoded on an artificially-generated propagated signal, e.g., a machine-generated electrical, optical, or electromagnetic signal, that is generated to encode information for transmission to suitable receiver apparatus for execution by a data processing apparatus. The computer storage medium can be or be part of a machine-readable storage device, a machine-readable storage substrate, a random or serial access memory device, or a combination of one or more of them. A computer storage medium is not a propagated signal.

To provide for interaction with a user, embodiments of the subject matter described in this specification can be implemented on, or configured to communicate with, a computer having a display device, e.g., a LCD (liquid crystal display) monitor, for displaying information to the user, and an input device by which the user can provide input to the computer, e.g., a keyboard and a pointing device, e.g., a mouse, a trackball or touchpad. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's device in response to requests received from the web browser, or by interacting with an app running on a user device, e.g., a smartphone or electronic tablet. Also, a computer can interact with a user by sending text messages or other forms of message to a personal device, e.g., a smartphone that is running a messaging application, and receiving responsive messages from the user in return.

While this specification contains many specific implementation details, these should not be construed as limitations on the scope of any invention or on the scope of what is being or may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially be claimed as such, one or more features from a claimed combination can in some cases be excised from the combination, and the claim may be directed to a subcombination or variation of a subcombination.

Similarly, while operations are depicted in the drawings and recited in the claims in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system modules and components in the embodiments described above should not be understood as requiring such separation in all embodiments, and it should be understood that the described program components and systems can generally be integrated together in a single software product or packaged into multiple software products.

Particular embodiments of the subject matter have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results. In some cases, multitasking and parallel processing may be advantageous.

In some implementations, alternative versions of the PSAD 100 can include more or fewer features than the PSAD 100, or can use the features in other ways than as described. In some implementations, a pet tracker version of the PSAD 100 can include tracking components of the PSAD 100, but may exclude the quick release switch. These and other implementations may exist in versions of the PSAD 100 in which there is no need to trigger an audible alarm. In some implementations, the pet tracker version of the PSAD 100 can include a different control other than the quick release switch, e.g., a beacon control. The beacon control can be used, e.g., by a person who has found the pet to cause a notification to be sent to the pet's owner. In this example, the PSAD 100 can generate and send a notification to the alarm monitoring center 222, or some other monitoring agency, which can then notify the pet's owner using registration information for the PSAD 100. In some implementations, a child tracker version of the PSAD 100 can include features that are similar to the features of the pet tracker version, or can include additional features. For example, the child tracker version of the PSAD 100 can include a panic button or other control by which the child wearing or possessing the PSAD 100 can call for help. In this example, pressing the panic button can cause the PSAD 100 to send a notification to one or more recipients. The recipients can include one or more of the parents or guardians of the child, law enforcement agencies, and the alarm monitoring center 222. Recipients who are contacted in this example can be defined by the parent or guardian when registering the PSAD 100. In some implementations, a vulnerable adult/medical tracker version of the PSAD 100 can include features similar to the child tracker version of the PSAD 100.

In some implementations, the alternative versions of the PSAD 100, including the pet tracker, child tracker, and vulnerable adult/medical tracker versions, can automatically generate notifications based on a determined geographic location. For example, some alternate versions of the PSAD 100 can generate a notification based on a threshold distance of the PSAD 100 from a central point or based on a determination that the PSAD 100 has left a pre-defined area. Registration of alternative versions of the PSAD 100 can optionally include user-input parameters specifying location and threshold distances for which notifications are to occur. In some implementations, registration can also include one or more of time-of-day and day-of-the-week parameters that are used to further define situations in which notifications are sent.

In some implementations, the PSAD 100 can include video or imaging features. The video or imaging features can be turned on by an external source or by the user of the PSAD 100, e.g., a child or adult wearing the PSAD 100. The PSAD 100 can send information captured by the video or imaging features to the alarm monitoring center or to other destinations.

In some implementations, an external trigger can activate the PSAD 100. The external trigger can be, e.g., an SMS message that is received by the PSAD 100 from an external source. The external source can be, e.g., a law enforcement agency, the alarm monitoring center 222, or an app on a mobile device. For example, for pet tracker, child tracker, and vulnerable adult/medical tracker versions of the PSAD 100, the SMS message received by the PSAD 100 can be "Identify the location of my pet/child/vulnerable adult." Upon receiving the message, the PSAD 100 can send a message that identifies the current location of the PSAD 100. In some implementations, the message can also include a rate of speed and a direction of travel.

What is claimed is:

1. A portable security alarm device (PSAD) comprising:

a subscriber identification module (SIM) card operable to store an international mobile subscriber identity (IMSI) number and a related key that together identify the PSAD to a mobile telephone carrier;

a cellular antenna;

a GPS antenna and a GPS receiver communicatively coupled to the GPS antenna;

a battery coupled to a sense circuit and operable to power the PSAD;

a quick release switch operable to provide a signal indicating an occurrence of a one-stroke activation of the quick release switch by a user;

an alarm operable to provide a loud warning sound; and a microcontroller including one or more processors and memory, wherein the microcontroller is operatively coupled to hardware components of the device, and wherein the microcontroller is configured with an operating system and software components, the software components including software configured to control the hardware components of the PSAD and perform operations comprising:

communicating with the mobile telephone carrier to determine a cellular location of the PSAD;

receiving GPS location information from GPS satellites to determine a GPS location of the PSAD, the GPS location being a higher precision location than the cellular location;

maintaining state information as to a current state of the PSAD, the current state being one of a plurality of states comprising an inactive state and an alarm state, the initial and default state of the PSAD being the inactive state;

maintaining the PSAD in ultra-low power consumption while the PSAD is in the inactive state;

receiving from the quick release switch an indication indicating that the quick release switch has been activated and in response change the state of the PSAD to the alarm state and provide normal power to all of the PSAD;

maintaining ultra-low power consumption of the battery during the inactive state and switching to normal power during the alarm state;

providing an alarm notification to an alarm monitoring center, the alarm notification including information identifying the PSAD;

providing a cellular location notification to the alarm monitoring center, the cellular location notification including information identifying a current cellular location of the PSAD;

providing a GPS location notification to the alarm monitoring center, the GPS location notification including information identifying a current GPS location of the PSAD;

causing the PSAD to enter the inactive state if the user cancels the alarm within the delay period; and causing the PSAD to send, in one or more messages to the alarm monitoring center, an alarm notification that includes information identifying the PSAD and a current alarm instance, a cellular location notification, and a GPS location notification, when the current cellular location and the current GPS location are available, respectively.

2. The PSAD of claim 1, wherein the operations further comprise:

providing a delay period for the user to cancel the alarm;

determining that the user has not canceled the alarm during the delay period; and causing the PSAD to send a message to the alarm monitoring center after the delay period, the message indicating that the user has not canceled the alarm.

3. The PSAD of claim 1, wherein the operations further comprise:

receiving a false alarm check trigger from the alarm monitoring center;

autonomously providing, without user intervention, a confirmation of the alarm state;

upon receiving a false alarm input to the PSAD, confirming a false alarm, transitioning the state of the PSAD to the inactive state, canceling additional alarm-related notifications, and sending, to the alarm monitoring center, a message indicating that the alarm is false;

upon receiving no user interrupt within a time period, providing a notification to the alarm monitoring center indicating a true alarm;

upon receiving a duress input, providing a notification to the alarm monitoring center indicating a true alarm and that the user has entered the deceptive continue interrupt input under duress; and determining and sending GPS location coordinates at fixed intervals indicating the current location of the PSAD.

4. The PSAD of claim 1, further comprising:

a keypad communicatively coupled to the microcontroller and operable to receive user input;

wherein the operations further comprise:

receiving a PIN input on the keypad;

determining that the PIN input matches a secret PIN stored on the PSAD and as a consequence transitioning the PSAD to the inactive state; and determining that the PIN input matches a secret duress PIN and as a consequence determining that the PSAD should remain in the alarm state and the alarm should be silenced.

5. The PSAD of claim 4, wherein the operations further comprise providing an alarm cancellation notification.

6. The PSAD of claim 1, wherein the operations further comprise:

disconnecting the battery from the battery-powered components of the PSAD, except the sense circuit, while the PSAD is in the inactive state.

7. The PSAD of claim 1, wherein the alarm notification, the cellular location notification, and the GPS location notification are provided in the form of one or more text messages, data messages, or voice messages to the alarm monitoring center.

8. The PSAD of claim 1, wherein the operations further comprise:

performing a battery test prior to transitioning the PSAD into the alarm state; and canceling the transitioning if the battery test indicates that the battery has a charge below a pre-defined threshold.

9. The PSAD of claim 1, wherein both the cellular antenna and the GPS receiver boot up simultaneously upon receipt of the battery voltage.

10. The PSAD of claim 1, wherein the mobile telephone carrier is an LTE (Long Term Evolution) cellular carrier.

11. The PSAD of claim 1, further comprising one or more processors operable to execute the software components and instructions of the PSAD, and wherein the software components include:

a main application operable to invoke, using a broker, other applications comprising:

a device registration and provisioning component operable to communicate, using a web application, with a web-based device registration service to complete registration of the PSAD, wherein information used during the registration includes at least a device identifier of the PSAD, a name of the user, a contact phone number of the user, and contact information for one or more other contacts of the user;

a cellular component that includes instructions for communicating with the mobile telephone carrier and determining the cellular location of the PSAD;

a GPS monitor that includes instructions for performing actions of the GPS receiver and determining the GPS location;

a sense system component that includes instructions for performing actions of the sense circuit; and a communication component that includes instructions for communicating with the alarm monitoring center.

12. The PSAD of claim 8, wherein the operations further comprise:

receiving a user input requesting a network test of cellular and GPS functionality of the PSAD;

providing normal power to network test components of the PSAD;

transitioning the PSAD to a powered-up inactive state;

initiating the network test including a GPS test and a cellular test;

providing an indication of an outcome of the network test to the user; and transitioning the PSAD to the inactive state.

13. The PSAD of claim 9, wherein:

the PSAD further comprises a network test button and the user input requesting the network test is a pressing of the network test button for a predetermined period, or the PSAD further comprises a keypad user interface and the user input requesting the network test is an input on the keypad user interface.

14. The PSAD of 9, wherein the outcome of the network test is provided using a display, LEDs of different colors, or both.

15. The PSAD of claim 1, further comprising a housing covering components of the PSAD while exposing the quick release switch.

16. The PSAD of claim 1, further comprising a battery low indicator connected to the battery and operable to:

determine a current charge of the battery; and indicate, using LEDs of different colors, whether the battery is sufficiently charged or in need of a charge.

17. The PSAD of claim 1, further comprising a flash memory operable to be written to over a universal serial bus (USB) or similar interface.

18. The PSAD of claim 1, further comprising a power management component that is controlled autonomously by a power management application residing on the microcontroller, wherein the power management component is managed through handshaking between the sense circuit, user interrupts, and acknowledgement or enable signals that determine when a specific action is completed that necessitates the PSAD to be transitioned to the inactive state.

19. The PSAD of claim 1, wherein operations of the microcontroller are performed without requiring a secondary device to respond to an alarm.

20. The PSAD of claim 1, wherein the PSAD is not in a continuous on state, enabling privacy protection and postposing transmission of data until a trigger is received to activate the PSAD.

* * * * *